United States Patent [19]

Glasgo

[11] Patent Number: 4,531,559

[45] Date of Patent: Jul. 30, 1985

[54] CLAMP-ON MARKING TEMPLATE AND SAW GUIDE FOR MAKING DOVETAIL JOINTS

[76] Inventor: Marion L. Glasgo, 11010 SE. 297th, Auburn, Wash. 98002

[21] Appl. No.: 586,873

[22] Filed: Mar. 7, 1984

Related U.S. Application Data

[63] Continuation-in-part of Ser. No. 480,890, Mar. 3, 1983, abandoned.

[51] Int. Cl.[3] ..... B27G 5/02

[52] U.S. Cl. ..... 144/85; 144/144 R; 144/144.5 R; 144/372; 83/761; 269/87.1; 30/290

[58] Field of Search ..... 144/85, 87, 144 R, 144 S, 144/144.56 T, 372; 145/129; 83/761, 746; 269/87.1, 87.2

[56] References Cited

U.S. PATENT DOCUMENTS

| | | | |
|---|---|---|---|
| 592,139 | 10/1897 | Griffith | 83/761 |
| 2,003,619 | 6/1935 | Williamson | 269/87.2 |
| 3,223,132 | 12/1965 | Erne | 144/87 |
| 3,424,450 | 1/1969 | Atkins | 269/87.1 |
| 3,878,875 | 4/1975 | McCord, Jr. | 144/144.5 R |
| 4,158,523 | 6/1979 | Schotzko | 145/129 |
| 4,168,730 | 9/1979 | Keller | 144/144 R |
| 4,341,375 | 7/1982 | Romanin | 269/253 |

FOREIGN PATENT DOCUMENTS

| | | |
|---|---|---|
| 0042244A1 | 12/1981 | European Pat. Off. . |
| 890022 | 2/1962 | United Kingdom . |
| 918980 | 2/1963 | United Kingdom . |
| 1358254 | 7/1974 | United Kingdom . |
| 1358771 | 7/1974 | United Kingdom . |
| 1502596 | 3/1978 | United Kingdom . |

*Primary Examiner*—W. D. Bray
*Assistant Examiner*—J. M. Griffin
*Attorney, Agent, or Firm*—Christensen, O'Connor, Johnson & Kindness

[57] ABSTRACT

A saw guide and marking template for marking and cutting pin and tail face cuts required in making dovetail joints. A central template having end faces that provide angled saw guides is clamped to the edge of the board to be worked. The angled saw guides can be repositioned by either rotating them about the end of its central template or inverting the entire device.

15 Claims, 11 Drawing Figures

Fig. 2.
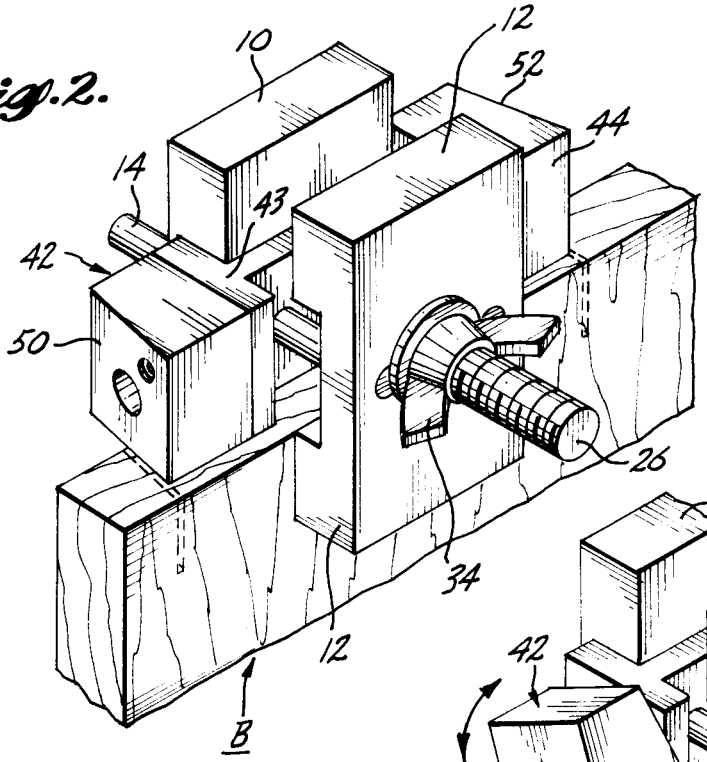
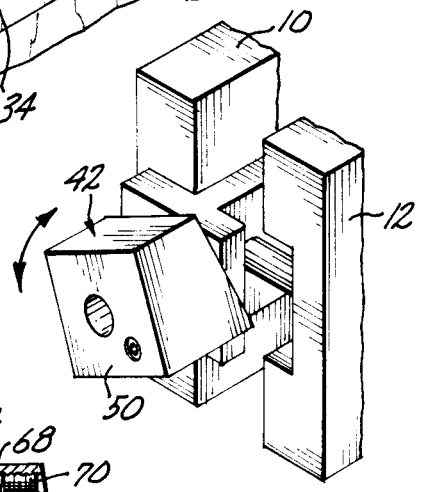
Fig. 4.
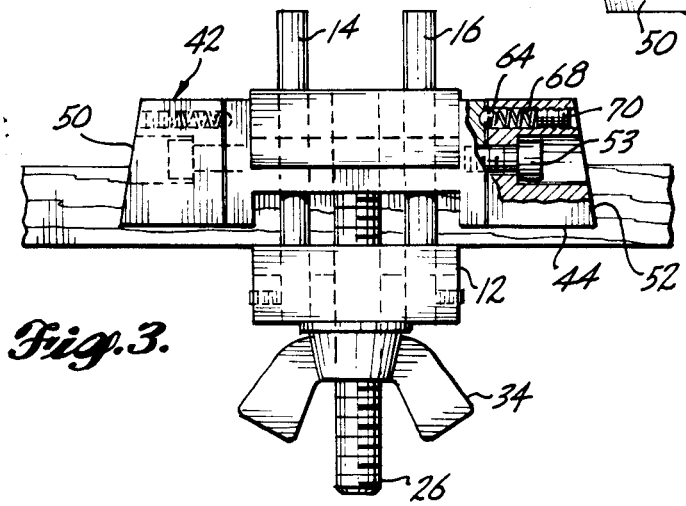
Fig. 3.

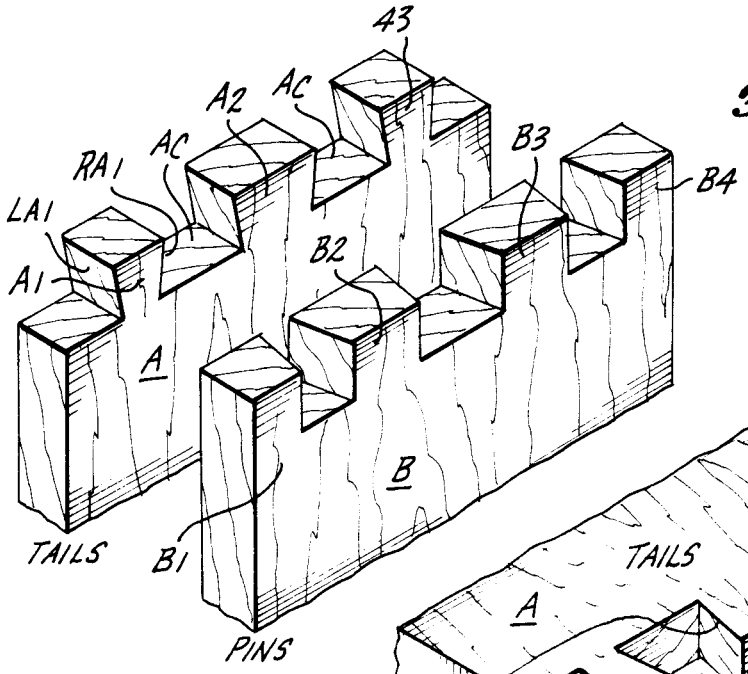
Fig. 8.
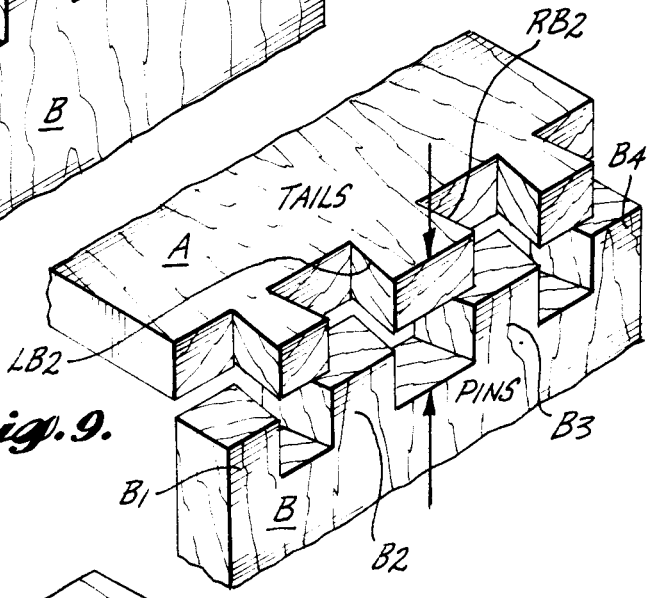
Fig. 9.
Fig. 10.
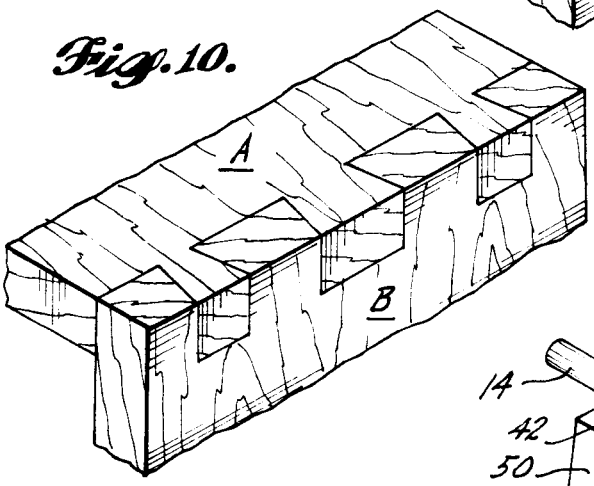
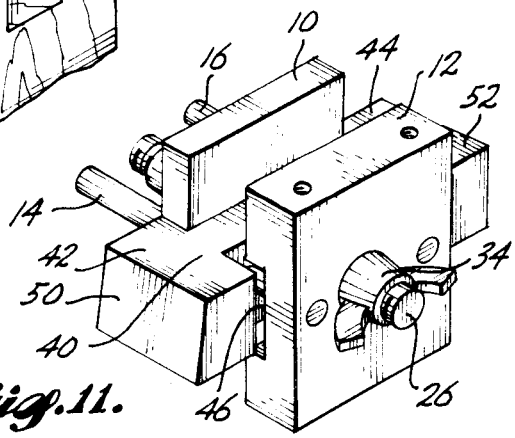
Fig. 11.

CLAMP-ON MARKING TEMPLATE AND SAW GUIDE FOR MAKING DOVETAIL JOINTS

This application is a continuation-in-part application based on prior copending application Ser. No. 480,890, filed Mar. 3, 1983, Clamp-on Marking Template and Saw Guide for Making Dovetail Joints now abandoned.

BACKGROUND OF THE INVENTION

This invention relates to a new and improved marking and saw guide useful in cutting the pin elements and the tail elements of dovetail joints. The invention is herein illustratively described by reference to its presently preferred form; however, it should be appreciated that modifications and changes may be made therein without departing from the essential features involved.

In producing a dovetail joint, precision in cutting the pins and tails is essential if the joint is to have a presentable appearance and if it is to be strong and durable.

The principal object of the present invention is to provide a compact, versatile and inexpensive marking and saw guide for that purpose.

A more specific object is to devise an easily used guide combining guide retainer clamp and guide surface components so configured and related as to perform the desired marking and/or saw guide functions in all of the four necessary guide surface orientative positions, that is, in forming the left side and right side cuts of both the pin elements and the tail elements. The new guide is constituted to serve in this role with boards of any thickness within a wide range at all cutting stations along the entire length of the joint edge of the board (e.g., to the very ends of the edge as required).

A novelty search conducted in the U.S. Patent and Trademark Office search files revealed the following prior art. None teaches the present concept, nor presents the combination of advantages or features indicated in the description that follows herein:

U.S. Pat. No. 3,223,132, Erne
U.S. Pat. No. 3,424,450, Atkins
U.S. Pat. No. 3,878,875, McCord, Jr.
U.S. Pat. No. 4,168,730, Keller.

SUMMARY OF THE INVENTION

In accordance with this invention, parallel clamp jaw plates preferably of generally rectangular form are guided for clamping action movement toward and from each other so as to grip and hold or release a board between them. Guide means for the clamp jaw plates, preferably in the form of spaced parallel shafts located in a plane intermediate opposite edges of the plates, permit the tool to be clamped on the edge of a board in either relatively inverted positions. Mounted between the clamp jaw plates, and also intermediate the same opposite edges of the plates, is a template having heads at opposite longitudinal ends thereof projecting beyond the opposite side edges of the clamp plates. Rotatably mounted to each template head are guide blocks having precisely angled saw guide faces integrally formed in the outwardmost edge of the blocks. The saw guide faces on each end of the template can be angled in two distinct planes. An angle formed by one saw guide face is used for marking and guiding the saw in cutting the side faces of the pins, and the other angle is used in cutting the sides of the tails of the proposed joint. A 180° rotation of either of the guide blocks, or inversion of the entire tool, realigns the angle of the saw guide face so that the opposite side of the pin or tail can be marked and cut.

Moreover, the guide blocks can be rotated at 90° intervals, changing the plane of each saw guide face such that the same guide face used for cutting a side of a pin can, after the 90° rotation, be used for cutting a side of a tail.

These and other features, objects and advantages of the invention will appear as the description proceeds with reference to the accompanying drawings.

BRIEF DESCRIPTION OF THE DRAWINGS

FIG. 2 is an isometric view of the device secured to a board with the guide blocks positioned to cut the sides of pins.

FIG. 3 is a top view of the device with a partial cutaway portion illustrating the pivot and detent means of the guide blocks.

FIG. 4 is a partial isometric view illustrating rotation of one guide block.

FIG. 8 is an isometric view of the associated ends of boards formed with matched pins and tails.

FIGS. 9 and 10 show the boards first being moved into interengagement of the pins and tails and finally as interjoined in a dovetail joint in the usual manner.

FIG. 11 depicts an isometric view of an alternative embodiment.

DETAILED DESCRIPTION

Figure 1:
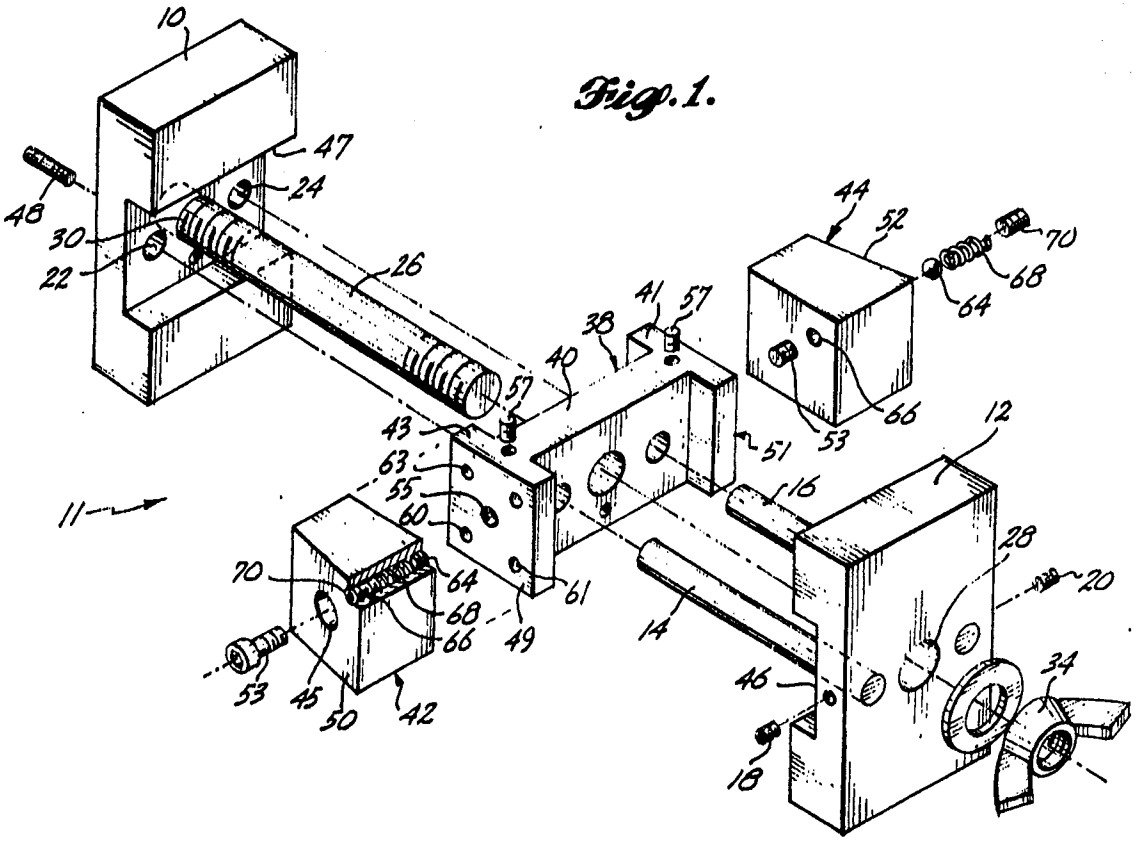
FIG. 1 is an exploded isometric view of the preferred embodiment.

Referring first to FIGS. 8–10, boards A and B have been prepared for interconnecting their ends by a so-called dovetail joint. The end of board A has been provided with a succession of tails and the end of board B with a succession of matching pins complemental to such tails. In the example, the tails are set back from the side edges of the board A to permit pins to be formed on the side edges of board B. It could, of course, be otherwise. In either case, tail $A_1$ has oppositely angled left and right side faces $LA_1$ and $RA_1$, which faces converge mutually with each angled in the plane of board A, such as at 80.5°, to the common plane defined by the tail base surfaces AC. The other tails have similarly angled side faces. Successive pins $B_1$, $B_2$, $B_3$ and $B_4$ have cut side faces similarly angled to (not "in") the plane of board B (such as left and right side face cuts $LB_2$ and $RB_2$ of pin $B_2$) so as to permit interengagement thereof with the tails by pressing the pins endwise of board B into interlocking engagement with tails $A_1$, $A_2$ and $A_3$, as shown by the arrows in FIG. 9, and by the completed resulting joint appearing to FIG. 10. Again, in the example, there is one more pin on board B than there are tails on board A, and the outer edge faces of the endmost pins are coextensive with the board's respective edges.

The improved tool comprises opposed generally rectangular clamp plates 10 and 12. Plate 12 has parallel guide shafts 14 and 16 projecting cantilevered from one face thereof held in bore holes in the plate by set screws 18 and 20. Projecting in fixed parallel relationship from the inside face of the plate in a transverse midplane thereof, the shafts are received in slidable engagement in similarly located bores 22 and 24 in opposing plate 10. The clamp actuator screw 26 passes slidably through aligned bore 28 and in the plate 12 and engages threaded bore 30 in plate 10 midway between guide shafts 14 and 16. Wing nut 34 is threaded on the projecting end of the clamp screw 26 at the outside face of plate 12 and provides for forcing the plates together and into engagement with opposite faces of a wood board or panel and also backing off the plates when desired. Because of the intermediate location of the shafts 14 and 16 and screw 26 (also of the template piece 38 to be described) the tool is invertible, an important feature for reasons which will appear as the description proceeds.

Between the clamp plates 10 and 12 is a template piece 38 having bore holes located in alignment with the guide shafts 14 and 16 and slidably engaged therewith; also having a non-threaded bore hole to pass the clamp screw 26. Template piece 38 comprises a plate-like body 40 extending parallel to the clamp plates. A notch or recess 46 in the inner wall of the clamp plate 12 accommodates the body plate 40 with the clamp plates in their relatively most advanced position (toward each other). Plate 10 is similarly notced 47 and is secured to template body 40 by machine screw 48 so as to rigidify the joint. Body 40 lies between opposite faces of plates 10 and 12 and is preferably of a length in the plane of shafts 14 and 16 only very slightly exceeding the corresponding width of plates 10 and 12.

The ends of body 40 form flange-shaped members 41 and 43 projecting orthogonally from the plane of body 40. The outwardmost surfaces 49 and 51 of the flange-shaped members provide surfaces upon which guide blocks 42 and 44 are rotatably mounted.

Referring, for simplicity, to one end of the template piece, guide block 42 is formed with center aperture 45. Aperture 45 is milled to accommodate countersunk pivot screw 53. The threaded end of the pivot screw 53 projects through the guide block 42 and mates with the threaded bore 55 formed in the center of surface end 49. Set screw 57 is inserted through the template piece through a bore so that force is applied against the threaded portion of pivot screw 53. The guide block is thus firmly mounted to the template piece and able to rotate about the longitudinal axis of that piece.

Referring to FIGS. 1, 3 and 4, the rotational movment of guide block 42 is controlled by detent means. Specifically, four hemispherical dimples 60–63 are formed at positions equidistant from the center of surface 49 and evenly spaced along a circle formed by a radius measured from the center of bore 55 to the center of any dimple. The purpose of the dimples is to receive spring-biased bearing 64. Bearing 64 resides in aperture 66 formed in guide block 42 and is forced toward the surface 49 by a spring 68 that is contained in the aperture by set screw 70. When guide block 42 is rotated to align aperture 66 with one of the dimples, spring 68 forces bearing 64 to seat in the hemispherical dimple, thereby securing the guide block in position until torsional force is applied by hand to overcome the spring force and rotate the guide block into another position. Dimples 60–63 are positioned so that, when secured by the above-described detent means, guide blocks 42 locks at four distinct positions so that the bottom side of the guide block will always assume a coplanar relationship with the bottom of template piece 38. This ensures that a flat, continuous surface is placed against the edge of a board. It is pointed out that identical mounting and detent means are applied to the other guide block 44, thus the same reference numerals are used in the drawings.

Referring now to FIGS. 2–7, the guide blocks 42 and 44 have precisely angled saw guide faces 50 and 52, respectively, forming the outwardmost longitudnal surfaces of the tool 11. Depending upon the orientation of a guide block, as discussed below, the corresponding guide face will provide a guide for marking or sawing a precise angular cut necessary for forming pins and tails.

As will appear, the construction of closely interfitted parts assures precise orientation of the end face 50 of template head 42 and that of end face 52 of template head 44 and thereby assures correct orientation of these guide surfaces relative to board A or B in making cuts in the board to form the pins and tails.

Figure 5:
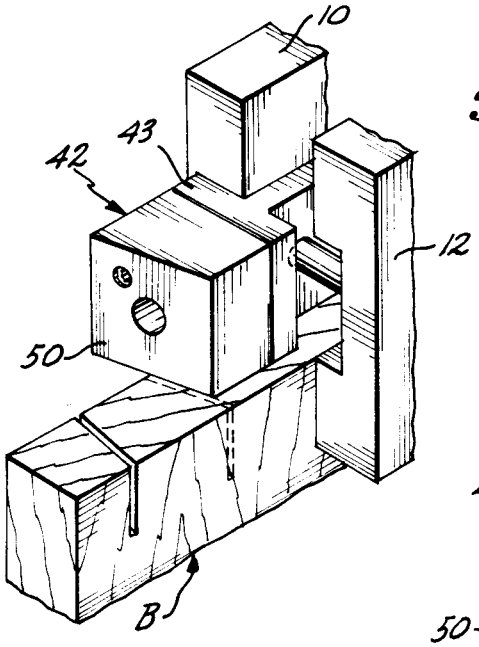
FIG. 5 is a partial isometric view illustrating the repositioning of the prominent guide block of FIG. 2 after a 180° rotation.
Figure 6:
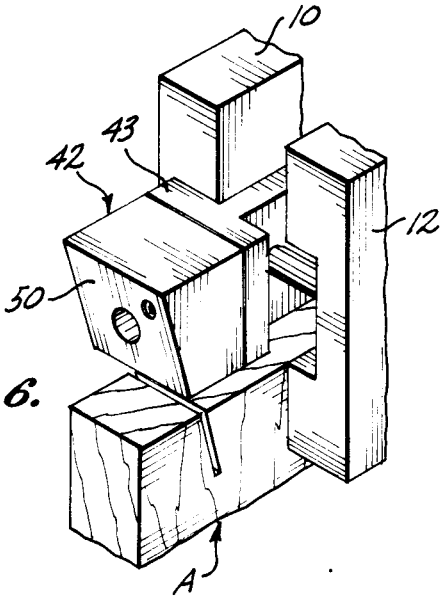
FIGS. 6 and 7 are partial isometric views of a guide block initially aligned to cut one side of a tail (FIG. 6) then rotated 180° to cut the opposite side of the tail (FIG. 7).
Figure 7:
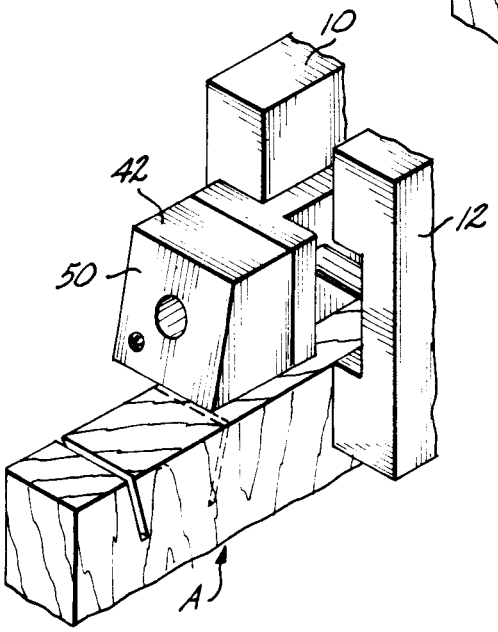

In normal operation, the tool's template piece is positioned at rest on the edge of the board and the board securely clamped between plates 10 and 12. Guide blocks 42 and 44 are rotated as shown in FIG. 4, to one of the four previously-described positions, the lower surface of each guide block rests firmly on the edge of the board. Depending upon how each guide block is rotated, end faces 50 and 52 are each capable of presenting guides for the four angles necessary for cutting tails and pins as shown in FIGS. 8 and 9 as reference letters $LA_1$, $RA_1$, $LB_2$ and $RB_2$. For example, FIG. 6 shows guide block 42 rotated and the tool securely clamped to board A to provide a guide face 50 for cutting or marking one side of a tail. FIG. 7 shows guide block 42 rotated, and the tools securely clamped, to provide a guide face 50 for cutting the opposite side of a tail. Similarly, FIG. 2 shows guide block 42 rotated to provide a guide face 50 for cutting or marking board B for one side of a pin and, finally, FIG. 5 shows guide block 42 rotated to provide a guide face 50 for marking or cutting the opposite side of a pin. Again, it is pointed out that the operation of the guide block 44 and saw guide face 52 on the other end of the template member is identical to that just described for guide block 42.

Working with either soft or hardwood may call for the tails and pins to be formed with different angular cuts. Therefore, the angles defined by saw guide faces 50 and 52 are not necessarily equal. This allows one tool to provide guides for cutting all four angles for two distinct sets of pins and tails. Additionally, because of the symmetrical design, the tool may be rotated about its vertical axis and reclamped to the board. This allows either saw guide face 50 or 52 to be used across the entire lengthwise edge of a board. It is pointed out that in lieu of rotating a particular guide block, the same effect may be achieved by inverting the entire tool on the edge of the board.

FIG. 11 depicts an alternative embodiment of the invention whereby guide blocks 42 and 44 are integrally formed with the template body 40. Instead of rotating one end of the device, the entire tool is inserted and reclamped to enable cutting both sides of pins or tails across the entire length of the board.

It will be recognized, once the angled faces of the pins and tails have been cut, that the worker must necessarily remove the intervening material where notches are to be formed, which he can do in any of different suitable ways convenient to his shop facilities and preferred technology.

If desired, the total physical length of the template piece or member 38 or of the guide heads 42 and 44 thereof may be selected as succession point gauges along the board's edge by which to position the tool at the proper spacing of marking and/or cutting points along such edge for cutting the pins and tails.

The simple, sturdy, gauge-like precision and compact construction of the guide make it easy to use, replacing the need for hand measurement and marking of a board edge. Further precision fitting of the dovetail joint is ensured since the joined pins and tails will have all been shaped by the exact same saw face guide.

These and other aspects of the invention will be evident from the description herein of its presently preferred embodiment.

The embodiments of the present invention in which an exclusive property or privilege is claimed are defined as follows:

1. A device for use in guiding manually made saw cuts in the end edges of boards to be joined by dovetail elements, said device comprising means forming parallel, back-to-back, board-engaging reference channels, each with a bottom member adapted to rest lengthwise upon the board's edge, and parallel side members adapted to engage and retain between them opposite faces of the board adjacent such edge, saw cut guide means at the respective ends of said reference channels, one such guide means being oriented to guide a saw for cutting in a plane obliquely inclined to a plane parallel to said side members, and the other such guide means being oriented to guide a saw for cutting a plane obliquely inclined to a plane orthogonal to said first-mentioned plane and generally transverse to the lengths of said reference channels, the respective guide means being operable to guide a saw in making pin face cuts and tail face cuts in the board, the angularity of which is reversed by inverting the device on the board.

2. The device defined by claim 1, including elongated, substantially parallel clamp plates forming the channel sides and an elongated template member mounted between the clamp plates and extending parallel to opposite edges thereof, said template member having parallel upper and lower faces transverse to the clamp plates and each adapted, with the device in one position or in the inverted position, to seat against the edge of a board to be cut for dovetail jointing, and means for guiding and actuating the clamp plates to clampingly engage and release a board between them with said template member resting by either of its faces against the edge of the board.

3. The device defined in claim 2, wherein the clamp plates are guided for movement toward and from each other by parallel shafts mounted on one plate and extending through the other plate and also extending through aligned bores in the template member.

4. The device defined in claim 3, wherein the clamp plates are actuated toward and from each other by means of a clamp screw extending through at least one of the clamp plates and said template member intermediate the guide shafts.

5. The device defined in claim 2, 3 or 4, wherein the template member comprises an elongated plate-like member having flat side faces extending parallel to the clamp plates and having enlarged template heads on the respective ends thereof thicker than said plate-like member and guide blocks rotatably mounted upon said template heads having flat saw guide faces on the respective outer ends thereof, so that depending upon the selected position of said guide blocks, each saw guide face is capable of guiding a saw for cutting both in a plane obliquely inclined to a plane parallel to said side members and in a plane obliquely inclined to a plane orthogonal to a plane parallel to said side members.

6. A tool for guiding saw cuts in the end edges of two boards for joining such edges together in a dovetail joint, said tool comprising an elongated reference member having mutually parallel, flat top and bottom reference faces, each adapted to seat upon such board end edges, said member having a transverse saw guide member rotatably mounted on at least one end thereof, and saw guide face integrally formed on outermost ends of said saw guide member, each such saw guide face capable of being angled either obliquely to the reference faces in a plane perpendicular thereto, or obliquely to the reference faces in a plane parallel thereto depending on the selected position of said rotatably mounted saw guide member, and holder means mounted on said reference member with transversely spaced, parallel elements engageable with the faces of such boards adjoining such end edges and projecting both upwardly and downwardly from the reference member so as to hold the reference member in fixed transverse relation to the board's end edge with either reference face seated upon such end edge.

7. The tool defined in claim 6, wherein the holder means comprises mutually parallel plate-like clamp elements and guide means interconnecting the same through the reference member to permit moving the clamp elements toward and from each other while maintaining them parallel.

8. The tool defined in claim 7, wherein the holder means further comprises clamp actuator means operatively interconnecting the clamp elements through the reference member.

9. The tool defined in claim 8, wherein the guide means comprises elongated parallel shafts mounted in fixed relation to one such clamp element, spaced apart transversely along the length of the reference member and extending slidably through bores in the reference member and the other such clamp element.

10. The tool defined in claim 9, wherein the clamp means comprises an elongated screw extending slidably through the reference member at a location between and parallel to the shafts.

11. The tool defined in any of claims 6–10, wherein the reference element, intermediate its ends, is of generally flat, plate-like form with flat opposing faces interconnected by said top and bottom reference faces, and at its respective ends abruptly widened horizontally to form template heads having relatively outer end faces rotatably attached thereon comprising said saw guide faces.

12. The tool of claim 6, wherein one said saw guide member is mounted on each of the respective opposite ends of said reference member.

13. The tool defined in claim 12, wherein the oblique angles formed by the flat saw guide face on one end of said template member are not equal to the oblique angles formed by the flat saw guide face on the opposite end of the template member.

14. The tool defined in claim 6, wherein the reference element intermediate its ends is of generally flat, plate-like form with flat opposing faces interconnected by said top and bottom reference faces, and its respective ends abruptly widened horizontally to form template heads having substantially flat outer end faces, said end faces having a central cavity, and said saw guide member having a centrally formed aperture accommodating a pivot element such that a protruding portion of said pivot element engages said central cavity providing rotatable mounting of said saw guide member to a said template head, and detent means incorporated between a said template end face and said saw guide member securing said saw guide member to said end face at incremental positions along the saw guide's rotational axis.

15. The tool of claim 14, wherein said detent means further comprises a plurality of indentations located at spaced locations about said end faces, an eccentric aperture in each side saw guide member, spring biased bearing secured in said eccentric aperture such that at selected positions along the saw guide member's rotational axis said spring biased bearing engages an indentation impeding further rotation of said saw guide member absent increased rotational force applied to said saw guide member.

* * * * *

UNITED STATES PATENT AND TRADEMARK OFFICE

CERTIFICATE OF CORRECTION

PATENT NO. : 4,531,559

DATED : July 30, 1985

INVENTOR(S) : Marion L. Glasgo

It is certified that error appears in the above-identified patent and that said Letters Patent is hereby corrected as shown below:

Column 2, line 59, "to" should be --in--

Column 3, line 5, delete "and" (first occurrence)

Column 3, line 25, "notced" should be --notched--

Column 3, line 64, "blocks" should be --block--

Column 4, line 7, "longitudnal" should be --longitudinal--

Column 5, line 29, insert --in-- after "cutting"

Column 6, line 49, delete "at"

Column 8, line 2, "side" should be --said--

Signed and Sealed this

*Twenty-ninth* Day of *October 1985*

[SEAL]

*Attest:*

DONALD J. QUIGG

*Attesting Officer*

*Commissioner of Patents and Trademarks—Designate*